US005960489A

United States Patent [19]

Hanel et al.

[11] Patent Number: 5,960,489

[45] Date of Patent: Oct. 5, 1999

[54] SUPPORT SYSTEM FOR BATH OR SHOWER TUBS

[75] Inventors: Bernd Hanel, Fellbach; Hans-Joachim Mai, Neubiberg; Dieter Krist, Winnenden; Gerhard Schmitt, Buchen, all of Germany

[73] Assignee: E. Missel GmbH, Stuttgart, Germany

[21] Appl. No.: 08/902,428

[22] Filed: Jul. 29, 1997

[51] Int. Cl.[6] ..... A47K 3/02

[52] U.S. Cl. ..... 4/538; 4/584

[58] Field of Search ..... 4/538, 584, 545, 4/559, 580, 585, 587

[56] References Cited

U.S. PATENT DOCUMENTS

| | | | |
|---|---|---|---|
| 2,010,036 | 8/1935 | Sakier | 4/538 |
| 2,010,791 | 8/1935 | Sakier | 4/538 |
| 2,143,034 | 1/1939 | Sakier | 4/538 |
| 2,967,309 | 1/1961 | Corp | 4/538 |
| 4,290,154 | 9/1981 | Benjamin | 4/538 |
| 4,669,133 | 6/1987 | Blecher et al. | 4/538 |

FOREIGN PATENT DOCUMENTS

| | | |
|---|---|---|
| 2419253 | 10/1975 | Germany . |
| 2 344 259 | 10/1977 | Germany . |
| 3425054C2 | 5/1986 | Germany . |
| 3525187A1 | 1/1987 | Germany . |
| 3907804A1 | 6/1990 | Germany . |
| 4126383A1 | 2/1993 | Germany . |
| 586748 | 3/1947 | United Kingdom . |

OTHER PUBLICATIONS

Misset's Bouwereld, 63(6), p. 706, (Mar. 17,1967).

*Primary Examiner*—David J. Walczak
*Attorney, Agent, or Firm*—Townsend and Townsend and Crew LLP

[57] ABSTRACT

A support system for bath tubs or shower tubs, which are provided with a tub rim which in particular extends around the tub, comprises at least one support rail which can be secured to a wall and support members which can be provided between the tub and the floor. In this arrangement, the surfaces of the wall and/or of the support rail facing the tub rim are covered, at least regionally, with an acoustic decoupling layer. The support members have at least one acoustically decoupling insulating element and an acoustically decoupling sectional element is provided, which can be positioned between the tub rim and the region confronting it of a support wall which can be erected beneath the tub rim.

43 Claims, 17 Drawing Sheets

SUPPORT SYSTEM FOR BATH OR SHOWER TUBS

BACKGROUND OF THE INVENTION

1. Field of the Invention

The invention relates to a support system for bath or shower tubs which are provided with a tub rim, in particular a tub rim extending all around the tub, and having at least one support rail which can be secured at the wall side and support members which can be provided between the tub and the floor.

2. Description of the Prior Art

In the installation of bath tubs, or shower tubs the problem generally exists that bridges which transmit structure-borne noise arise through the connections to the building construction which result during installation. These bridges are not only undesired, but rather also frequently make it impossible to satisfy existing regulations and recognized technical rules with respect to insulation against structure-borne noise.

Even if it is supposed to be possible to ensure the required insulation against structure-borne noise at the floor side in the required manner, as a result of the thermal and footfall insulation located beneath a floating floor screed, the problem exists that pronounced disturbing noise bridges, in particular, also arise via the support wall or skirt which is to be mounted in front of the tub.

It would indeed be basically possible to achieve the required noise insulation or insulation against structure-borne noise through intentional, but also complicated and expensive measures during the installation of such tubs, however, such special installations cannot be realized on normal building sites where, as a rule, it is necessary to work under time and cost pressure and with less qualified personnel.

DESCRIPTION OF THE PRESENT INVENTION

An object of the invention is to provide a support system of the initially named kind which is extremely simple to handle and which can, in particular, be installed in a technically correct manner without exceptional specialist knowledge which thereby ensures that disturbing structure-borne noise transmission into the building construction is reliably precluded, whereby ultimately a tub installation should be made possible which is technically correct and which meets the existing regulations and recognized technical rules.

This object is satisfied in accordance with the invention essentially in that the surfaces of the wall confronting the tub rim and/or the support rail are covered, at least regionally, with an acoustically decoupling layer; in that the support members have at least one acoustically decoupling insulating element; and in that an acoustically decoupling sectional element is provided which can be positioned between the tub rim and the region confronting it of a support wall which can be erected beneath the tub rim.

The principle of the invention thus lies in the consequential provision of acoustic decoupling at all those positions at which the tub in connected to the building construction or supported on an element corrected to the building construction. Since the tub is supported, on the one hand, via its tub rim at support rails connected to the building construction or at support walls erected in front of the tub and, on the other hand, is supported via the tub base on floating floor screeds or rough mooring, acoustically decoupling materials are provided in accordance with the invention at these positions between the tub and the element respectively supporting it.

The acoustic decoupling is specifically achieved in accordance with the invention in that

- the support rail is occupied by an acoustically decoupling layer on which the tub rim of the installed tub is supported, with the tub rim coming exclusively into contact with the acoustically decoupling layer and not with the support rail itself and being separated from the constructional body by acoustically decoupling layers or sections,
- in that an acoustically decoupling sectional element is provided on or at a support wall or skirt erected in front of the tub and is so arrayed that the tub rim in the region of the support wall or the skirt exclusively comes into contact with the sectional element and not with the support wall or the skirt itself, and
- in that the support members to be provided at the tub rim or at the floor side have an insulating element which acoustically decouples the tub from the floor screed, or from the rough floor, or are manufactured of an acoustically decoupling solid material.

Through this consequential acoustic decoupling it is for example possible, when using the support system of the invention, to dispense with support walls or supporting dry-built walls or the need to especially acoustically decouple the floor region located under the tub from the remaining building construction. Since the acoustic decoupling of the support walls, supporting dry-built walls or floor regions represents a considerable cost and complexity in comparison to the installation of the support system of the invention, a very economical and easy to handle system is provided by the invention in comparison to the prior art with which, moreover, an improved acoustic decoupling of the tub from the building construction is possible in comparison to the prior art It is already evident, from the measures carried out hitherto, that the acoustic level of bath and shower tubs which are held by a support system in accordance with the invention lies under 30 dB(A) with a diagonal measurement, whereas, in systems in accordance with the prior art, noise levels above 40 dB(A) are measured.

The support system of the invention can be used for all commercially available bath and shower tubs of any desired shape, and these shower tubs can consist of steel, cast iron or plastic. When using rectangular or square tubs straight support rails or sectional elements can be provided, whereas, when using differently shaped tubs, round tubs, half-round tubs or oval tubs, support rails or sectional elements must be used which have been correspondingly adapted to this shape.

The simple construction of the support system of the invention has proved to be particularly advantageous as a result of which the installation can easily be learnt and carried out, with the installation effort being restricted to a minimum. Moreover, the simple layout ensure that the parts used in the context of the support system of the invention are so robust that they can straightforwardly withstand the conditions at the building site without losing their acoustic or acoustically decoupling characteristics.

Since the individual parts of the support systems of the invention can be made available in various sizes, or can be put together in module-like manner into different sizes, no waste or only little waste arises during the installation of the support system of the invention, which represents an advantage from environmental points of view.

The support system in accordance with the invention can be used for the mounting of a tub at any in-built height customary in practice in technical sanitation installation.

This is because the support rails can be mounted at any desired height at the wall, the sectional elements can be provided on support walls of any desired height and the floor sites or members can either be made adjustable or can be made available in different heights, so that different spacings between the floor screed or the rough floor and the tub base can be realized.

With the support system of the invention the fitter can straightforwardly adapt to different in-built situations, that is to say the support system can be mounted both prior to and also after the tiling of a bathroom, with it being possible to use both thin bed and also thick bed tiling. This flexible possibility of use of the support system of the invention will be explained in further detail in the context of the description of the figures and reference will in particular be made to the fact that the tube can be secured without problem with one, two or three-sided fixing to the wall.

In a preferred embodiment of the invention the measures described ensure, on the one hand, that no direct contact exists between the support rail and the tub rim in the context of the wall fixing of the tub. On the other hand, a wall side acoustic decoupling element can be provided which is secured between the wall a which the support rail is secured and the region of the tub rim facing it. The tub which is supported on the support rail covered with the acoustic decoupling layer can in this case in any event not slide so close to the wall during installation that a direct contact results between the tub and wall, since the said additional acoustic decoupling element is provided between the tub and the wall. The additional acoustic decoupling element can in this respect also serve to ensure a uniform spacing between the tub and the wall or between the tub and tiling which has to be subsequently installed.

All the acoustically decoupling materials which have been described or will be described and which can be used in the context of the invention, in particular the acoustic decoupling layer of the support rail, the insulating element of the support members, the sectional elements of the support wall and the wall side acoustic decoupling element, can consist of soft resilient material, soft plastic, polystyrene, cork, elastomeric substances, rubber, natural rubber, coconut, soft foam, in particular PE foam, hard foam or the like or of combinations of these materials.

In a preferred embodiment of the invention the support rail, the sectional element which can be positioned between the tub rim and the support wall and/or the wall side acoustic decoupling element can be formed as individual parts which can be put together in the longitudinal direction and which, in particular, have a length of 60, 90 or 120 cm. In this way, the support system of the invention can be adapted without difficulty to different tub sizes and can, moreover, be sold in small handy packaging units.

In a further preferred embodiment of the invention all parts of the support system in accordance with the invention are made moisture resistant.

DESCRIPTION OF THE PREFERRED EXEMPLARY EMBODIMENTS

Figure 1A:
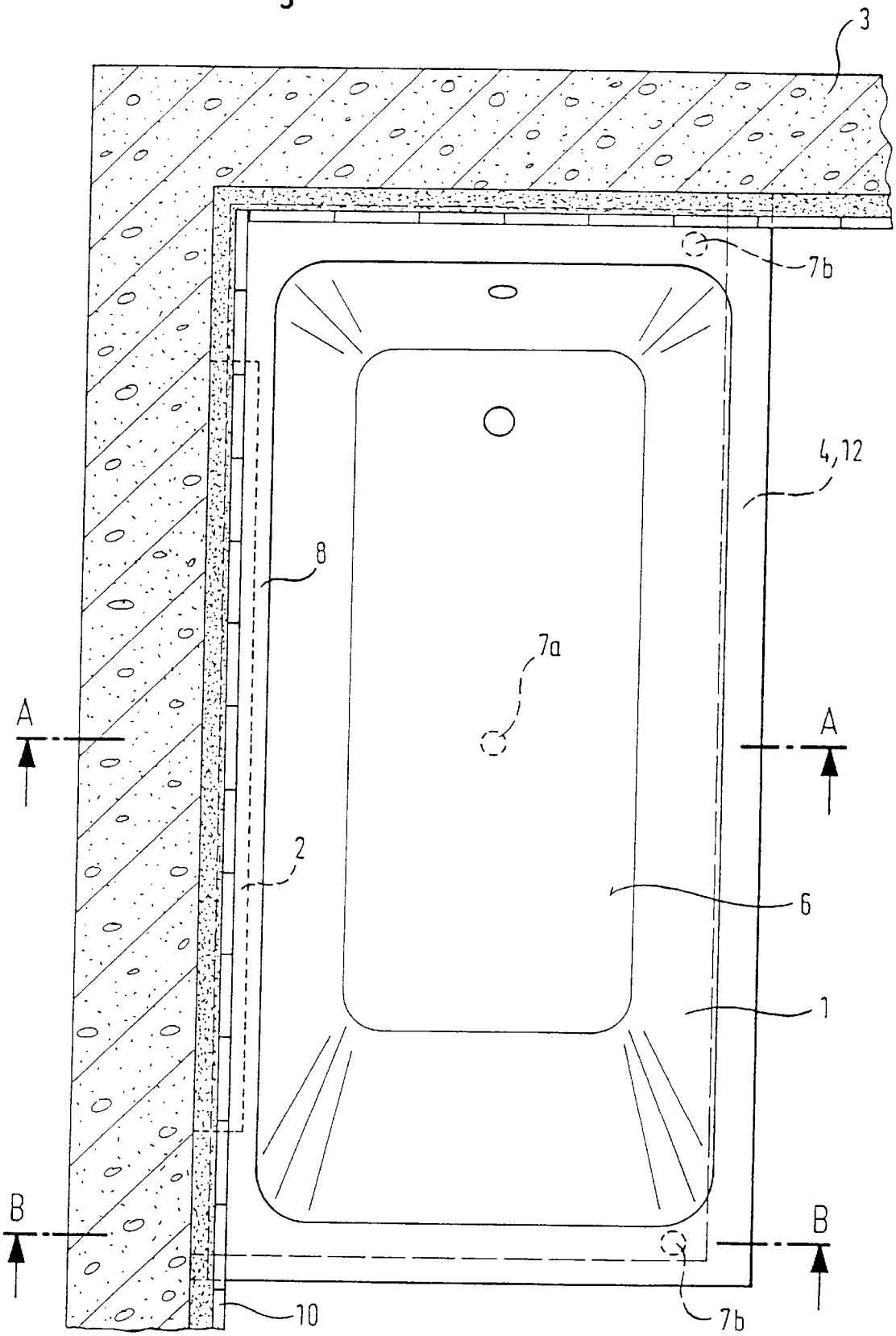
FIG. 1*a* is a plan view of a bath tub which is secured with a support system in accordance with the invention.

FIG. 1*a* shows a plan view an a tub 1 which is supported by a support system in accordance with the invention at two sides on a wall and at least at one further side on a support wall 4, 12. Moreover, the tub base 6 is supported via a support member 7*a* relative to the floor screed. Finally, two further support members 7*b* are provided which support the tub rim in two of its corner regions, likewise with respect to the floor screed.

Figure 1B:
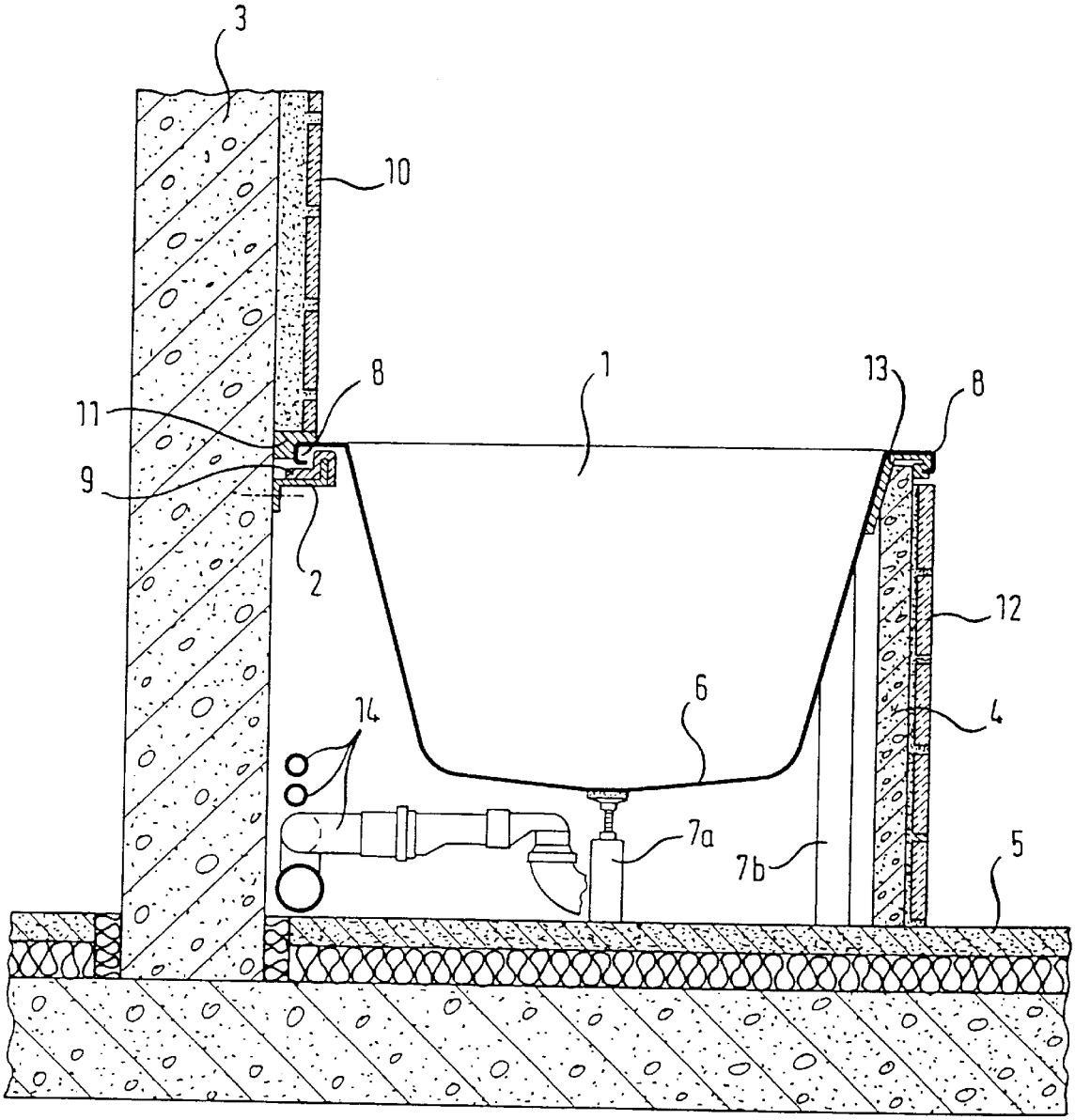
FIG. 1*b* is a vertical section in accordance with the section line A—A of FIG. 1*a*.

FIG. 1*b* shows a sectional representation along the section line A—A of FIG. 1*a*.

The sectional illustration of the bath tub 1 can be seen in FIG. 1B. The tub is supported by the carrier system of the invention, on the one hand, at the wall 3 via a carrier rail 2 and, on the other hand, on the support wall 4 which lies opposite to the support rail 2. In addition, three support members 7*a*, 7*b*, of which only two are visible in FIG. 1, are provided between the floor rested 6 and the tub rim and/or the tub base 6. An embodiment is also conceivable in which only two or more than three support members 7*a*, 7*b* are provided.

The tub 1 has a tub rim 8 which is bent outwardly and extends around it, via which the tub 1 is supported at the support wall 4 on the carrier rail 2 and on the support member 7*b*.

If, in an alternative embodiment no support wall will be present (so-called dry construction, see also FIG. 14), then the tub rim 8 can also be supported on only one or on several support members, the construction of which can correspond to that of the support member 7*b* shown in FIG. 1. The length of the support members must, however, be matched to the spacing between the floor screed 5 and the tub rim 8.

The support rail 2 has a Z-shaped section and is, for example, mounted to the wall 3 by means of a screw connection. The support rail 2 mounted on the wall 3 forms, together with the wall 3, an upwardly open receiver of U-shaped cross-section for an acoustic decoupling layer 9. The section of the decoupling layer 9 in matched to the support rail and the tub rim 8 is supported on it. The wall 3 is provided with tiling 10 which ends above the tub rim 8.

An L-shaped acoustic decoupling element 11 is provided between the tiling 10 and the tub rim 8, i.e. between the wall 3 and the tub rim 8, and brings about additional acoustic decoupling of the tub 1 relative to the wall 3 and relative to the tiling 10. Moreover, it ensures a constant and uniform spacing between the tub rim 8 and the tiling 10, i.e. between the tub rim 8 and the wall 3.

The support wall 4 which is likewise provided with tiling 12 is covered in its upper region by a sectional element 13 for acoustic decoupling. The shape of the element is matched to the tiled support wall 2 and ensures that a direct contact between the tub rim 8 or the tub 1 and support wall 4 or tiling 12 is avoided.

The support members 7*a*, 7*b* have at least one acoustic decoupling insulating element which ensures that no bridges for structure-borne noise can arise between the base 6 of the tub and the floor screed or between the tub rim 8 and the floor screed 5. A possible embodiment of a support member 7*a*, 7*b* is, for example, shown in FIGS. 13*a* and 13*b*.

In a preferred embodiment of the invention the support members are arranged at the side of the tub or tub base 6 remote from the support rail 2. In this manner, adequate place is provided at the side of the tub base 6 facing the support rail 2 for the provision of pipe conduits 14. The support members are arranged displaced relative to one another in the longitudinal direction of the tub, in each case at approximately the same spacing to the wall 3.

Figure 1C:
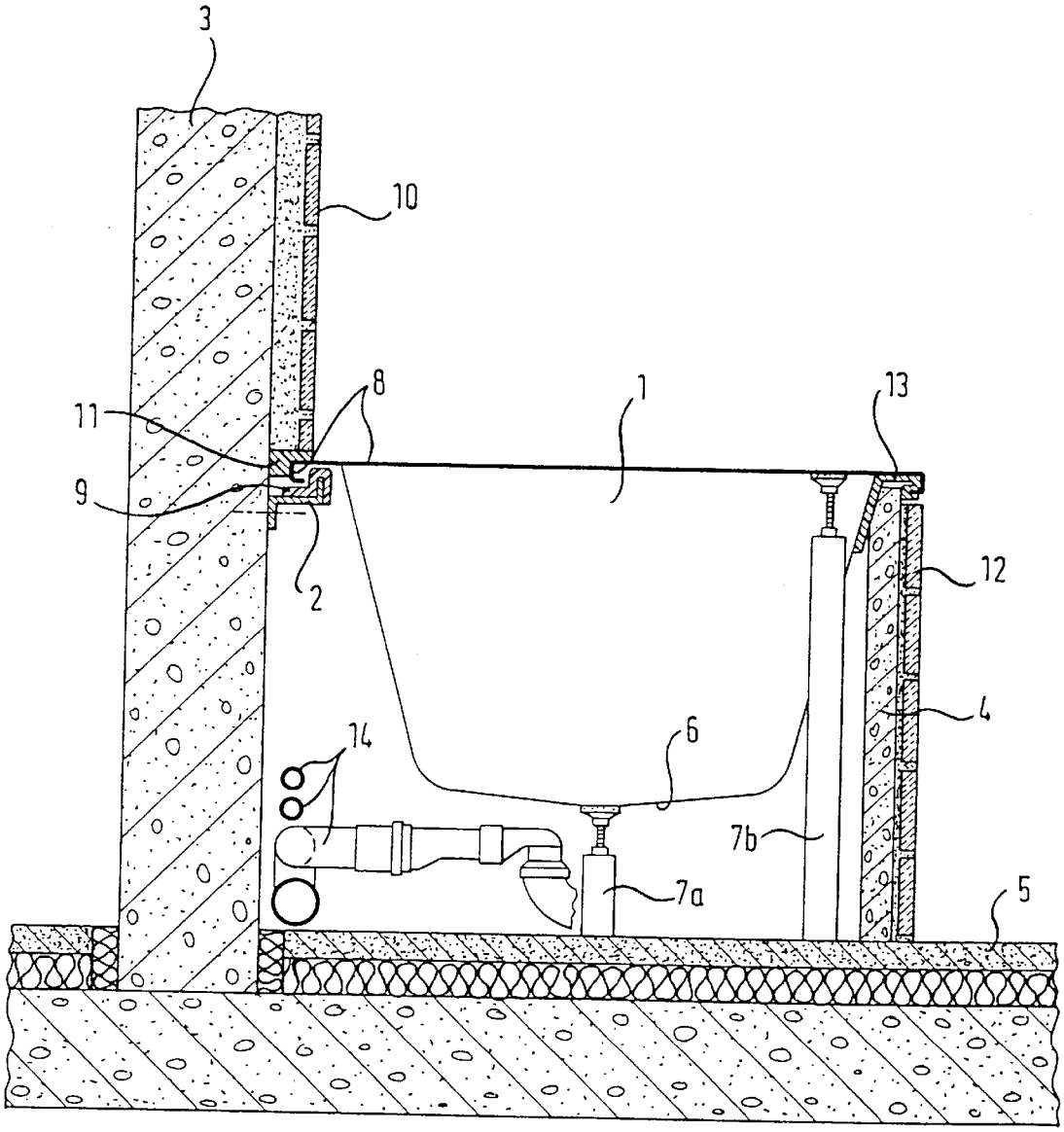
FIG. 1*c* is a vertical section in accordance with the section line B—B of FIG. 1*a*, FIGS. 2*a* to 2*c* show different installation situations of a bath tub.

FIG. 1*c* corresponds substantially to FIG. 1*b*, however here, it is only the support members 7*b* which are arranged in the corner regions of the tub 1 which can be fully seen. These support members 7*b* are of variable length and can thus be adapted to the spacing between the tub rim 8 and the floor screed 5.

Figure 2A:
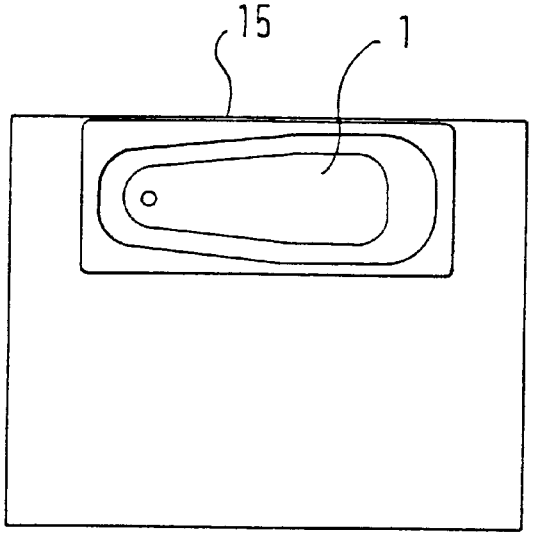
Figure 2B:
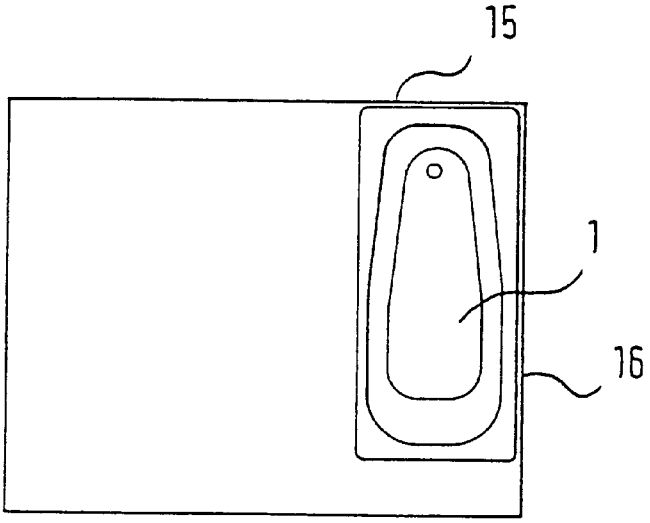
Figure 2C:
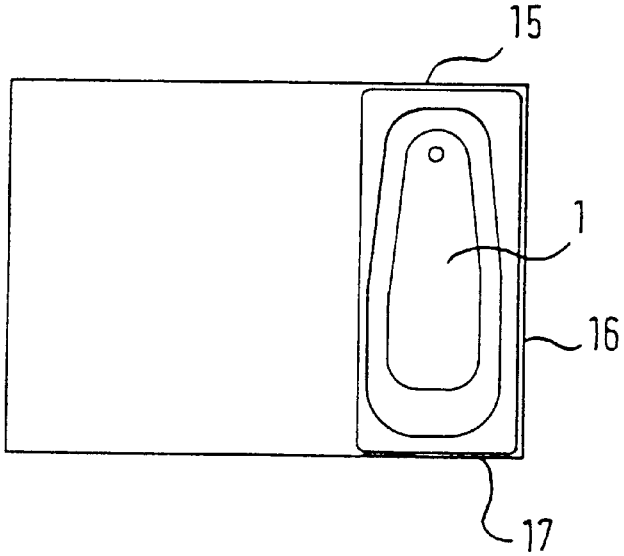

FIGS. 2*a* to 2*c* show various situations which can arise when installing a bath tub in a bathroom. In FIG. 2*a* the tub 1 merely contacts the wall 15 at one of its longitudinal sides. With this one sided wall connection the tub 1 is held at the wall 15 by means of a support rail in accordance with the invention.

The other three sides of the tub 1 are supported on support walls erected beneath them.

FIG. 2*b* shows a two-sided wall connection of the tub 1 at the walls 15 and 16 and here the two sides of the tub 1, which lie opposite to the walls 15 and 16, are respectively carried by support walls.

FIG. 2*c* shows a three-sided wall connection of the tub 1 at the walls 15, 16 and 17 and the tub 1 is simply carried at the side opposite to the wall 16 by one support wall With an installation situation in accordance with FIGS. 2*b* and 2*c* the tub must be held at at least one of the walls 15, 16 or 15, 16, 17 by means of a support rail, it is, however, also possible to hold the tub 1 at several of the walls 15, 16 or 15, 16, 17 by means of a respective support rail.

The number of support rails used with an installation situation in accordance with FIGS. 2*b* and 2*c* is, for example, dependent on the tub material that is used. For plastic tubs, a rim support at all sides is as a rule necessary, whereas with tubs of steel or cast tubs a support at only one support wall and at an oppositely disposed wall can be sufficient.

When using dry paneling (FIG. 14) instead of walling or bricking the tub in, it is necessary to support the tub rim of a tub via at least two support members at the base side and at the rim. Furthermore, the tub base is to be supported at its base side via at least one support member. Possible embodiments of suitable support members are described in connection with FIGS. 13*a* and 13*b*.

In addition, attention must be paid to achieving an acoustically decoupled wall mounting, which can, for example, be brought about with a correspondingly designed clamping anchorage or anchoring dowel (DE 43 24 133.6, EP 94 110 896.1), or a similar device.

Figure 3:
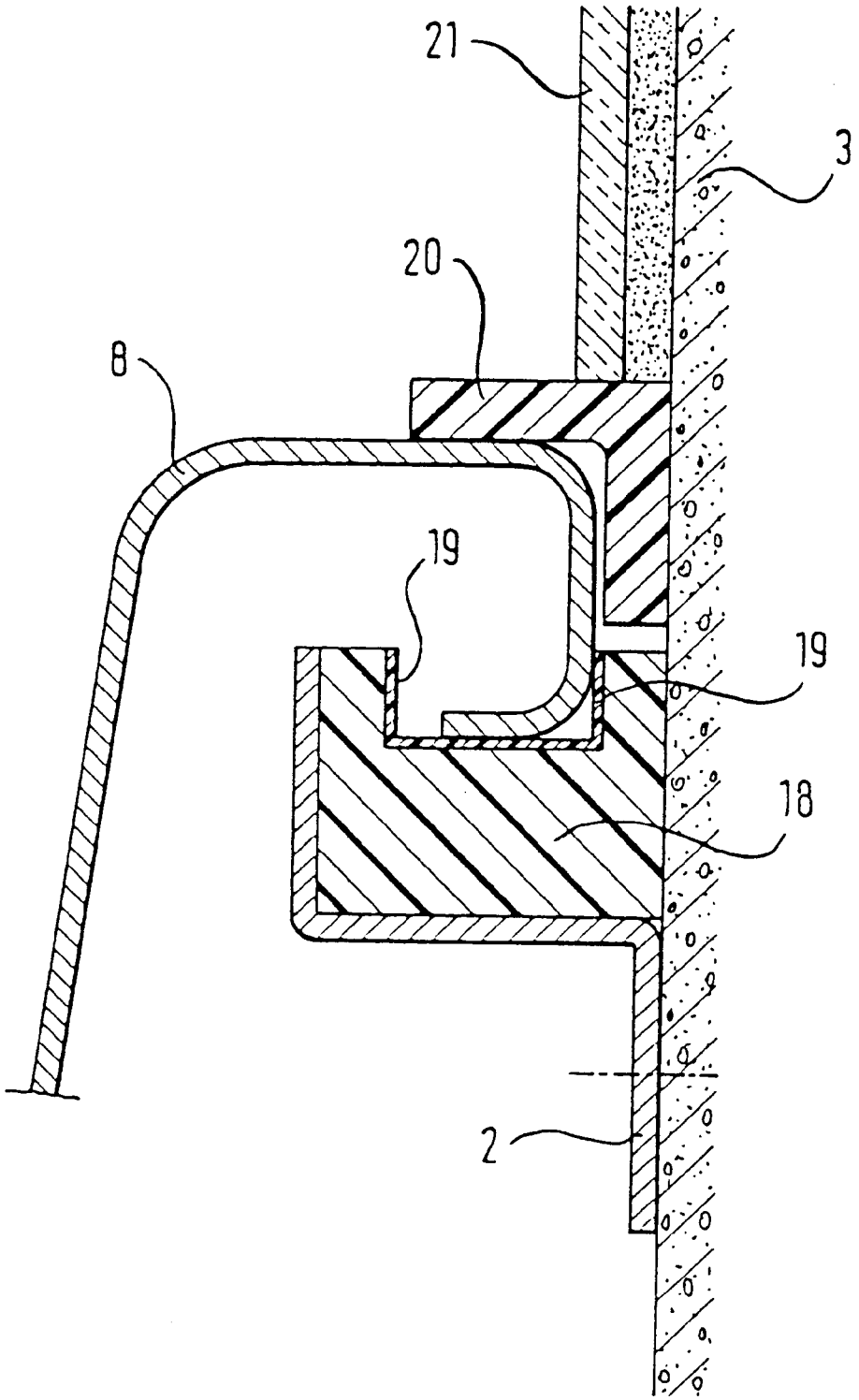
FIG. 3 is a possibility of mounting a rub at a wall in accordance with the invention by means of a support rail.

FIG. 3 shows a detailed view of a support system in accordance with the invention in which a tub rim 8 bent over outwardly is secured in the customary manner via a support rail 2 to a wall 3. The support rail 2 is formed in accordance with FIG. 1 and provides in this manner, together with the wall 3, an upwardly open receiver for an acoustic decoupling layer 18 which is substantially U-shaped in cross-section and which in turn has an upwardly open recess for the tub rim 8.

Galvanized steel, aluminium and the like are suitable for the manufacture of the support rail 2 and attention should preferably be paid to ensuring that the material used is moisture-resistant.

The upwardly open recess of the acoustic decoupling layer 18 which serves to receive the tub rim 8 is occupied by a load distribution layer 19 which can in particular be manufactured of hard plastic, aluminum, or the like. The load distribution layer 19 is preferably adhesively bonded into the recess of the acoustic decoupling layer 18 or pressed into it. The tub load, i.e. the total load of tub, water and user can be uniformly distributed by the load distribution layer 19 over the length of the support rail 2.

The load distribution layer 19 is not necessary when a material is used as the acoustic decoupling layer 18 which has both good acoustic decoupling characteristics and can also be mechanically loaded without the deformation which occurs being too great. In this respect, the use of a polyurethane elastomer is for example appropriate.

An acoustic decoupling element 20 is provided between the wall 3 and the region of the tub rim 8 facing it, with the acoustic decoupling element 20 having an L-shaped cross-section with one limb of this acoustic decoupling element 20 extending horizontally above the tub rim 8 and the other limb extending vertically between the tub rim 8 and the wall 3.

The acoustic decoupling element 20 satisfies two different tasks:

On the one hand, the acoustic decoupling element 20 brings about an effective acoustic decoupling between the tub rim 8 and the wall 3. It is impossible, through the provision of the acoustic decoupling element 20 for the tub to be displaced for example in such a way that the tub rim 8 directly contacts the wall 3 and an acoustic bridge arises in this manner.

On the other hand, the acoustic decoupling element which has a constant cross-section over its entire length ensures that a uniform spacing is maintained between the tub rim 8 and the wall 3 and, moreover, that a constant spacing is ensured from tiling 21 mounted at the wall 3 above the tub 8

Preferred embodiments of the acoustic decoupling element 20 will subsequently be described in connection with the FIGS. 5 to 9.

Figure 4A:
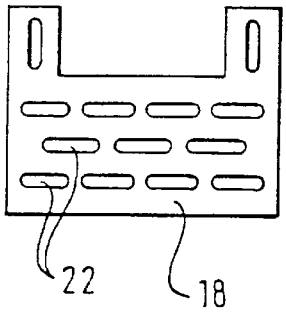
FIGS. 4*a* to 4*c* show different embodiments of an acoustic decoupling layer which can be used in connection with a support rail.
Figure 4B:
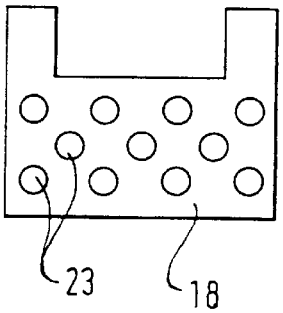
Figure 4C:
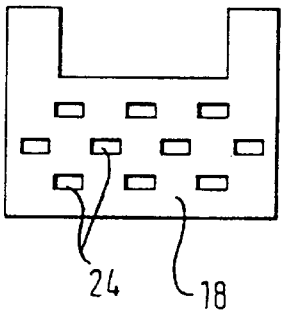

FIG. 4 shows two possible embodiments of the acoustic decoupling layer 18 of FIG. 3. In order to increase the acoustically insulating action of the acoustic decoupling layer 18, it can be provided with openings which, in particular, extend in the direction of its longitudinal axis or also transversely thereto. These openings, which can also be included in other acoustic decoupling elements of the support system of the invention, preferably have the following cross-sections:

FIG. 4*a* shows for example openings in the form of elongate slots 22, FIG. 4*b* shows openings in the form of bores 23, and FIG. 4*c* shows openings in the form of rectangular apertures 24. However, any other desired shapes of the openings 22, 23, 24 can be realized.

Figure 5:
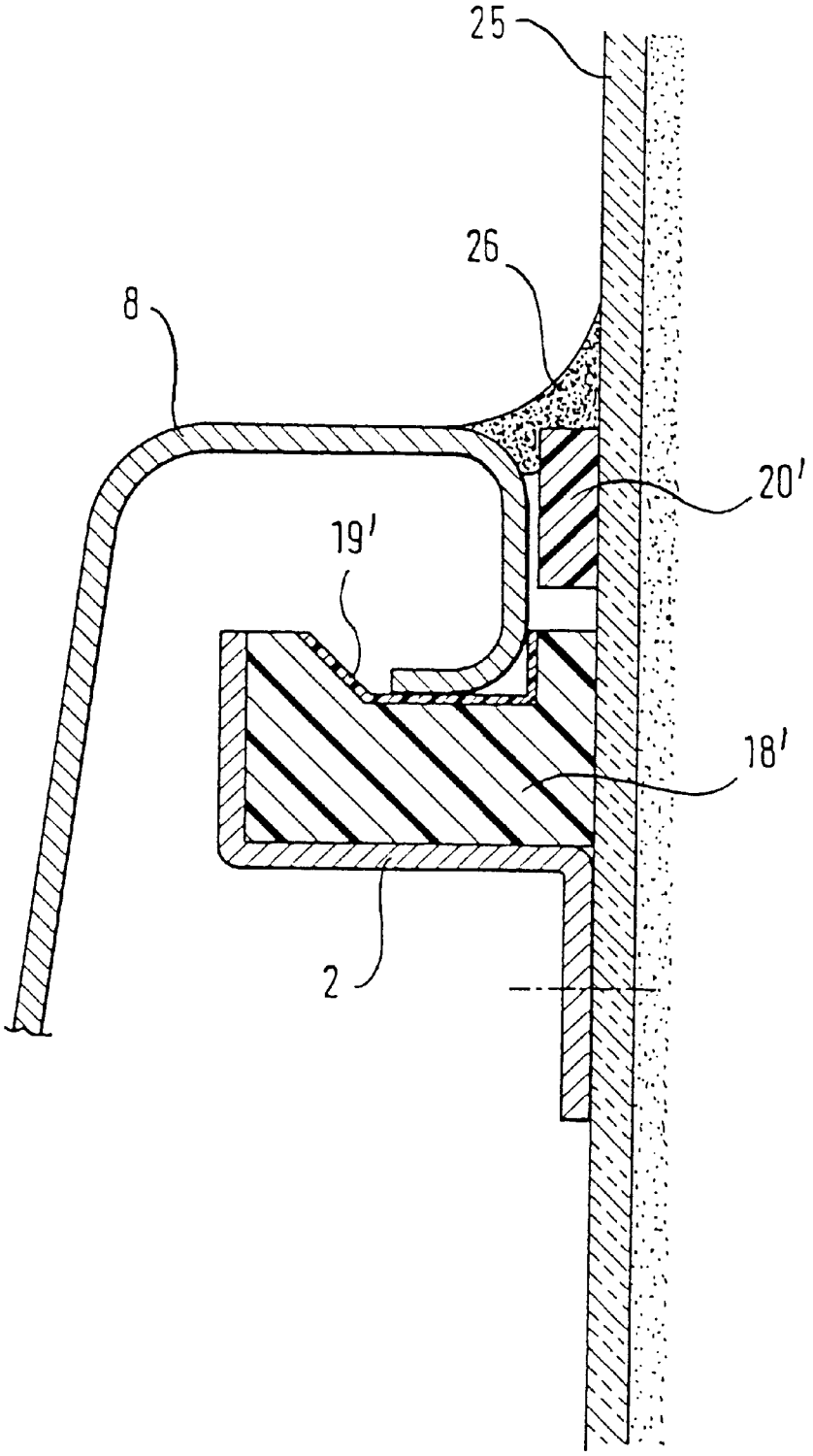
FIG. 5 is a further possibility of installing a tub at a tall by means of a support rail.

FIG. 5 shows an embodiment in which a tub is mounted by its tub rim 8 at an already tiled wall 25 by means of a support rail 2.

Support rail 2, acoustic decoupling element 18' and load distribution layer 19' are formed analogously to FIG. 3, with it being evident from FIG. 5 that other cross-sectional shapes are possible with respect to the cross-section of the acoustic decoupling layer 18 and the load distribution layer 13 of FIG. 3.

The acoustic decoupling element 20' serves in the embodiment of FIG. 5, on the one hand for the acoustic decoupling of the tub rim 8 and the wall 25 and ensures, on the other hand, a constant spacing between the tub rim 8 and the wall 25. The cross-section of the acoustic decoupling element 20 can be selected to be rectangular in the embodiment of FIG. 5 since the acoustic decoupling element 20', in contrast to the embodiment of FIG. 3 in which it has an L-shaped cross-section, does not have to take care of a constant vertical spacing between the tiling and the tub rim 8 because the wall 25 of FIG. 5 has already been fully tiled.

In order to prevent the penetration of spray water or slopping water into the intermediate space between the tub rim 8 and he wall 25, and in order to achieve a pleasing appearance of the overall arrangement for the user, a permanently resilient joint 26, for example consisting of silicone, is provided above the acoustic decoupling element 20' between the tub rim 8 and the wall 25. Any eventually required colored matching can for example be effected via the joint A further advantage of the system of the invention lies in the fact that the joint 26 no longer has to have an acoustic, sound decoupling function in comparison to the prior art, so that during the mounting of the joint 26, no attention has to be paid to such acoustic decoupling characteristics, because the acoustic decoupling is already ensured by the provision of the acoustic decoupling layer 18' and of the acoustic decoupling element 20'.

Figure 6A:
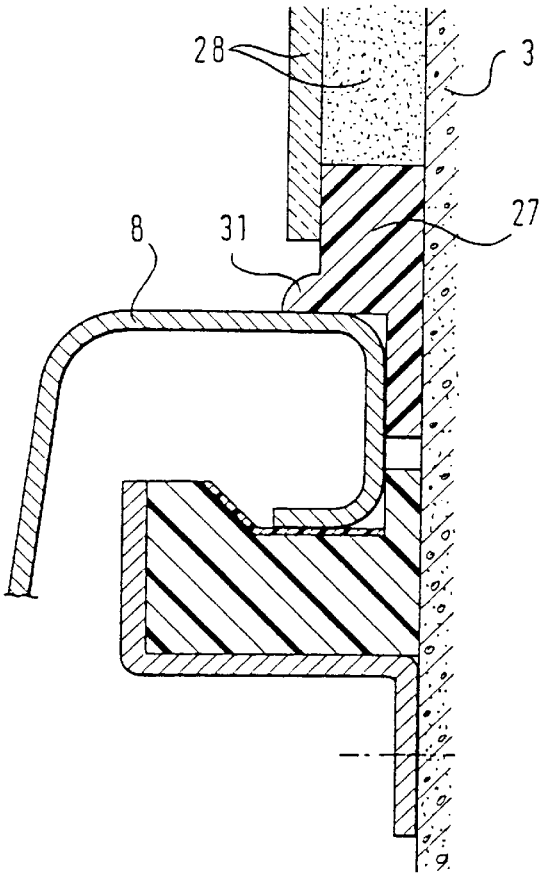
FIGS. 6*a* to 6*c* show various sections of an acoustic decoupling element which can be positioned in accordance with the invention between the tub rim and the wall.
Figure 6B:
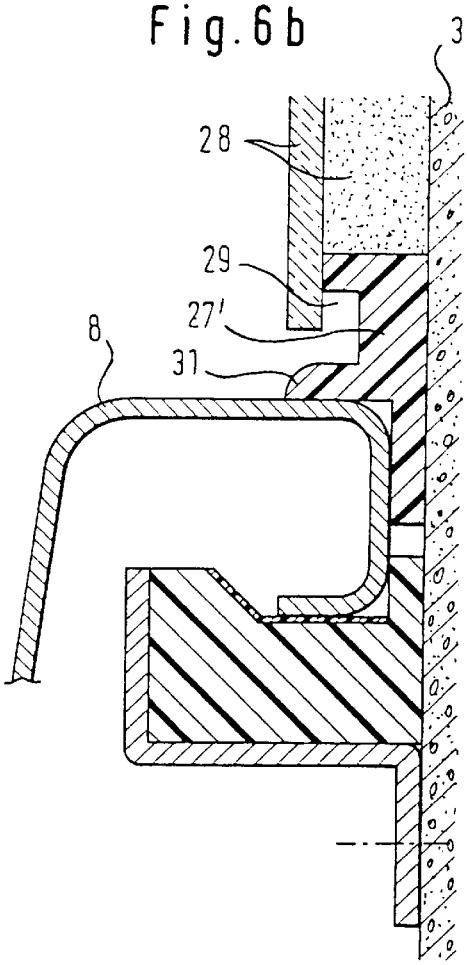
Figure 6C:
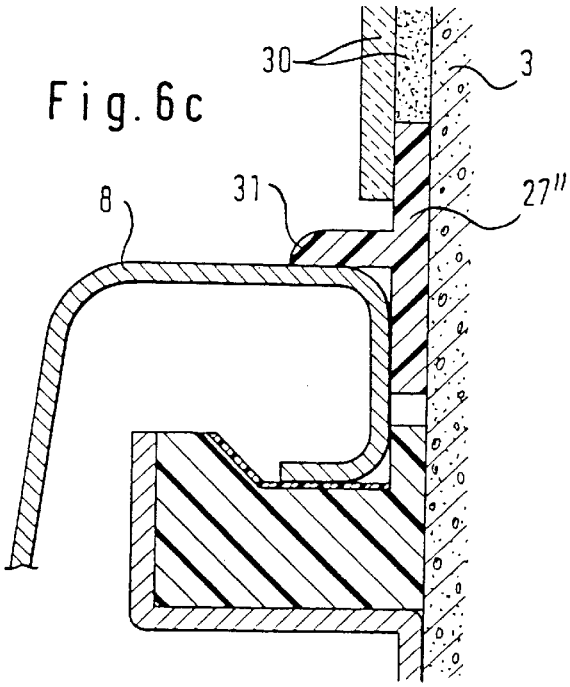

FIGS. 6*a* to 6*c* show possible cross-sectional shapes of an acoustic decoupling element which can be provided between the tub rim 8 and the wall 3. The acoustic decoupling element 27 of FIG. 6*a* is so dimensioned that it can be used in connection with thick-bed tiling 28 attached to the wall 3.

In the upper region located between the tiles and the wall, the acoustic decoupling element 27 determines the corresponding spacing. In just the same way it provides a comparatively smaller spacing between the tub rim 8 and the wall 3 in its lower region with the thick-bed tiling of FIG. 6*a*.

The acoustic decoupling element 27' of FIG. 6*b* corresponds essentially to the acoustic decoupling element 27 of FIG. 6*a*, but in FIG. 6*b* a recess 29 is provided in the region above the tub rim 8 and confronting the tiles. The Acoustic decoupling element 27' in also suitable for thick-bed tiling 28.

FIG. 6*c* shows an acoustic decoupling element 27" which is suitable for thin-bed tiling 30. The horizontal dimensions of the acoustic decoupling element 27" in the region located between the wall 3 and the tiles is here correspondingly smaller in comparison to FIG. 6*a* and 6*b*.

All acoustic decoupling elements 27, 27', 27" in accordance with FIGS. 6*a* to 6*c* are provided with a sealing lip 31 which extends away from the wall 3 horizontally above the tub rim 8 and which is rounded off in its end region. The sealing lip 21 ensures that no slopping water or spray water can penetrate into the region between the tub rim 8 and the wall 3. The provision of the sealing lip 31, which in particular contacts the top side of the tub rim 8 under prestress, makes the use of an additional silicone joint superfluous, whereby the installation effort is further reduced.

Figure 7C:
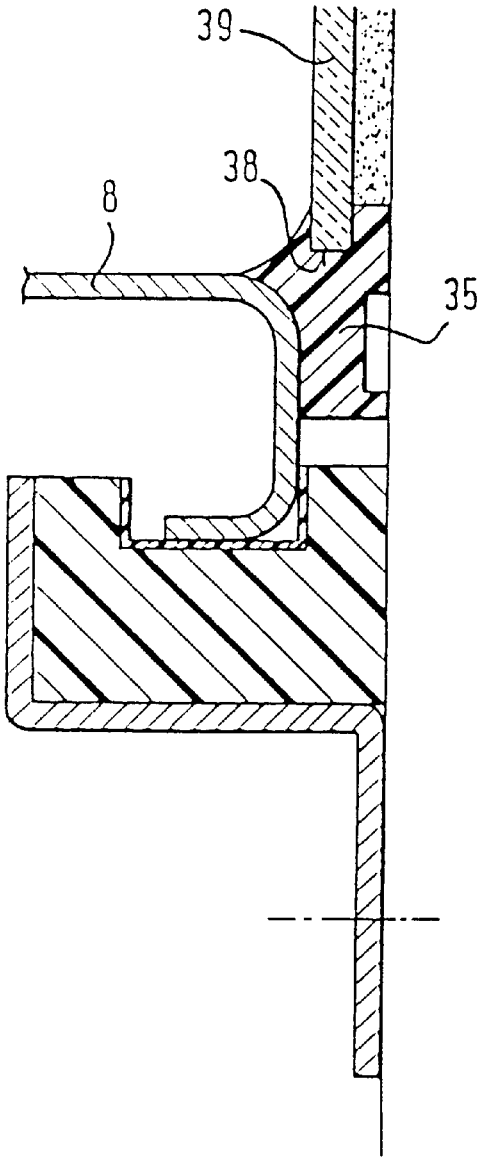
FIGS. 7*a* to 7*c* show further possible sections of an acoustic decoupling element which can be positioned in accordance with the invention between the tub rim and the wall.
Figure 7A:
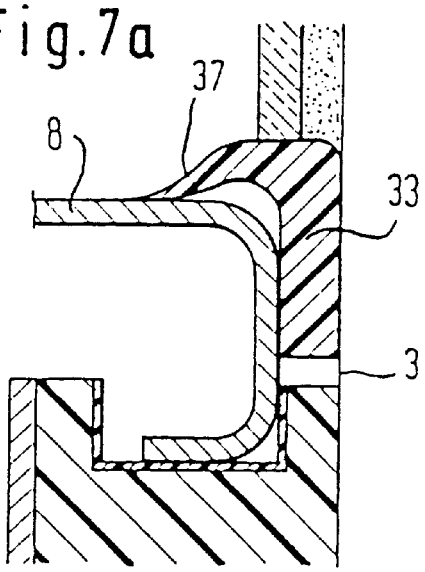
Figure 7B:
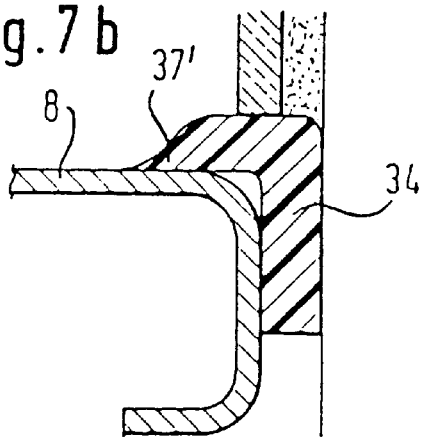

FIGS. 7*a* to 7*c* show further possible embodiments of the acoustic decoupling elements in accordance with FIG. 6.

The acoustic decoupling elements 33 to 35 in accordance with FIGS. 7*a* to 7*c* are suitable for use with a wall which is to be subsequently tiled.

The upper region of the acoustic decoupling elements 33 to 35 is in each case so formed that when the acoustic decoupling element is inserted it has essentially the appearance of a joint which tapers along the wall 3 and along the tub rim 8.

A seal of the gap which exists between the tub rim 8 and the wall 3 is achieved by the acoustic decoupling elements 33 to 35.

FIG. 7*a* shows an acoustic decoupling element 33 which has a tapering sealing lip 37 which contacts the tub rim 8 under prestress.

The acoustic decoupling element 34 in accordance with 7*b* also has a corresponding sealing lip 37', with the two limbs of the acoustic decoupling element 34, which extend perpendicularly to one another after installation, preferably extending at a more acute angle to one another prior to installation in order to achieve a prestress of the sealing lip 37 relative to the tub rim 8 after the instillation.

A particularly good sealing action can be achieved with the described prestress in accordance with FIG. 7*a* and 7*b*.

The acoustic decoupling element 35 of FIG. 7*c* has a vertically downwardly extending groove 38 from its upper edge into which a tile 39 can engage. If the width of the tile 38 is matched to the thickness of the tile 39 then a particularly good seal can be achieved between the tiled wall and the tub rim 8.

FIG. 8 shows, in contrast to the previously described examples, the wall-side support of a tub rim 40 which is not bent outwardly and downwardly in the customary manner, but is rather formed as an upright tub rim 40. The support system of the invention can also be used in advantageous manner with such support rims 40.

With an upright tub rim 40 the use of an acoustic decoupling layer 41, which is essentially L-shaped in cross-section, also offers itself when using a likewise Z-shaped support rail 2. The thinner, vertically upwardly extending limb of the L-shaped decoupling layer 41 determines the spacing of the tub rim 40 to the wall 3.

Figure 8A:
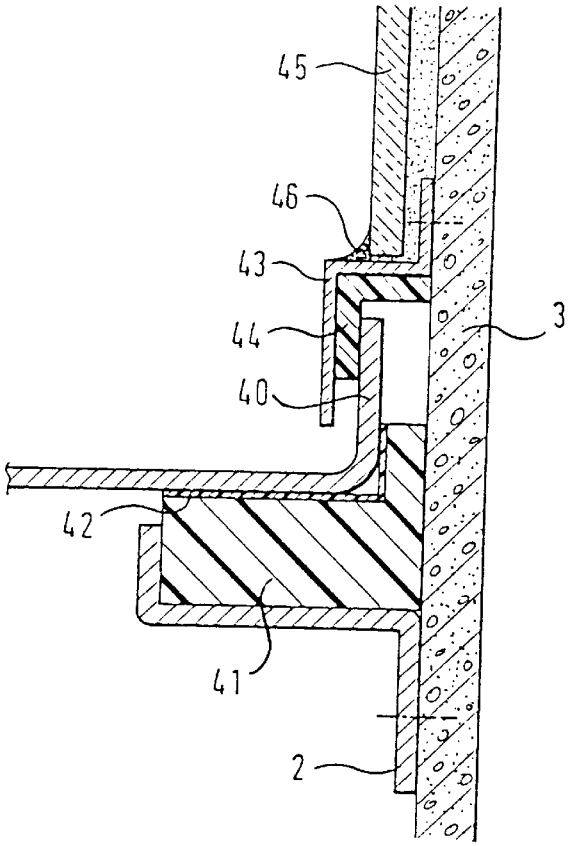
FIGS. 8*a* to 8*c* show various possibilities of mounting a tub with a tub rim on a wall by means of a support rail.

The acoustic decoupling layer 41 can, in the preferred embodiment of FIG. 8*a*, be covered in accordance with the already described examples with a load distribution layer 42, which is however now correspondingly adapted to the shape of the acoustic decoupling layer 41 and consequently likewise has an L-shaped cross-section.

Above the upwardly bent around end of the tub rim 40 a Z-shaped holding section 43 is secured to the wall 3 and engages over the upwardly bent region of the tub rim 40 from the top while forming a gap between the tub rim 40 and the holding section 43. An acoustic decoupling element 44 is arranged in the said gap and extends vertically within this gap and horizontally above the tub rim 40 towards the wall 3 so that the acoustic decoupling element 44 as a whole has an L-shaped cross-section.

Tiles 45 mounted on the wall 3 end directly above the horizontally extending region of the holding section 43 so that this region of the holding section 43, which extends at a constant vertical spacing from the tub rim 40, ensures a constant spacing of the tiles 45 from the tub rim 40.

A gap which may eventually be present between the tiles 45 and the holding section 43 can be sealed off by means of a joint 46 which consists in particular of silicone.

Figure 8C:
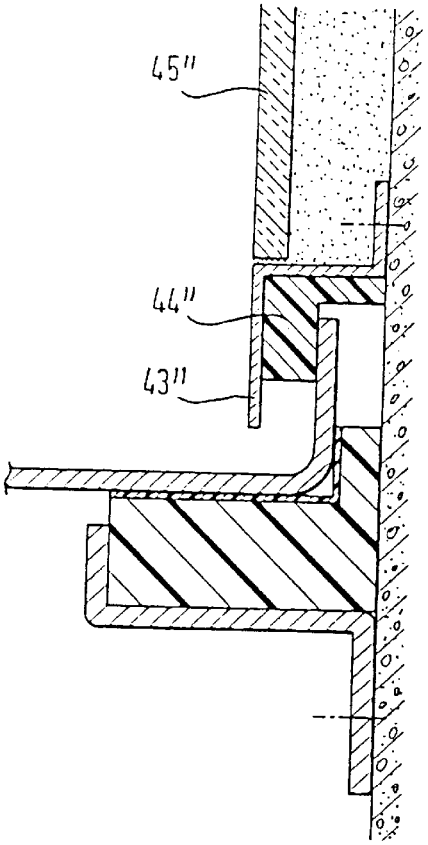
Figure 8B:
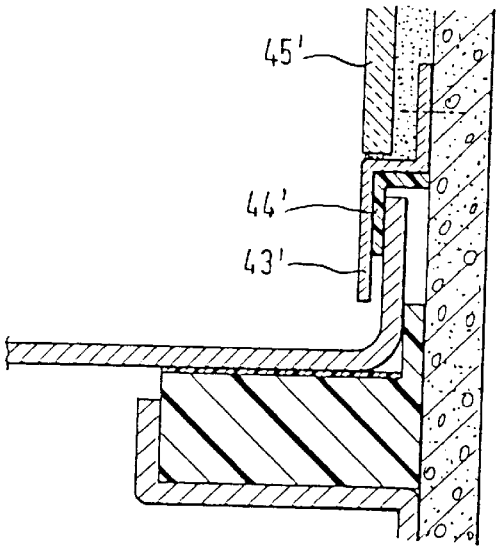

The horizontal dimensions of the holding section 43 and the acoustic decoupling element 44 can also be made correspondingly smaller in accordance with FIG. 8*b* in order to provide in this way a flush transition at the room side between the tile 45' and the lower, vertically extending region of the holding section 43'. With this flush transition the use of a silicon joint can also be dispensed with.

The embodiments shown in FIGS. 8*a* and 8*b* are each suitable for use with thin-bed tiling.

FIG. 8*c* shows an embodiment which is suitable for use with thick-bed, tiling. Here, the horizontal dimensions of the holding section 43" and the acoustic decoupling element 44" are selected to be correspondingly larger.

Figure 9A:
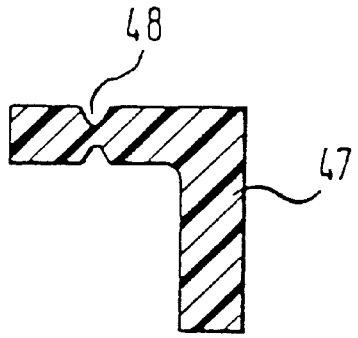
FIGS. 9*a* to 9*c* show possible embodiments of an acoustic decoupling element which can be positioned at the wall side between the tub and the tub rim.
Figure 9B:
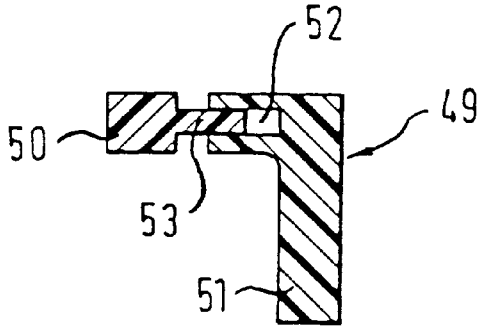
Figure 9C:
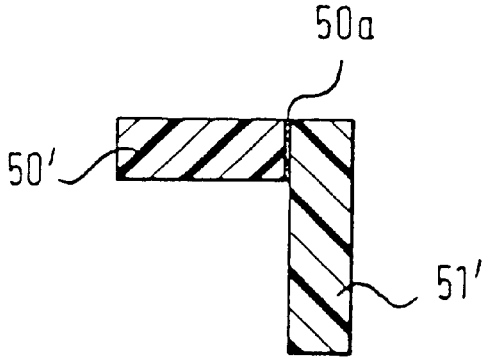

FIGS. 9*a* to 9*c* show possible embodiments of an acoustic decoupling element such as can for example be used in an apparatus in accordance with FIG. 3.

In order to be able to take account of the respective thickness of the tiles that are used, or of a selectively usable thin-bed or thick-bed tiling, the acoustic decoupling element 47 in accordance with FIG. 9*a* can also be provided with a location 48 at which fractures are intended to take place and at which a part of the acoustic decoupling element can be broken off, so that its horizontally extending region can also be shortened in accordance with the particular requirements. It is likewise possible to provide a plurality of locations of intended fracture 48 which are spaced apart from one another.

If the locations of intended fracture 48 are dispensed with entirely, then the acoustic decoupling element 47 can, for example, be cut off prior to or after the installation in accordance with the particular requirements, for example by means of an knife.

FIG. 9*b* shows an acoustic decoupling element 49 which has a substantially L-shaped cross-section and consists of two parts 50, 51.

The substantially vertically extending part 51 has a horizontal groove 52 into which a tongue 53 mounted on a substantially horizontally extending part engages. The tongue 53 is thereby horizontally displaceable in the groove 52.

Through this design it is possible to set the horizontal dimensions of the acoustic decoupling element 49 in accordance with the prevailing requirements by a relative displacement of the two parts 50, 52.

Alternatively it is possible, in accordance with FIG. 9*c*, to contact the two limbs 50, 51' of the acoustic decoupling element together via adhesive bonding 50*a* and, if required (for example after the tiling has been finished), to tear off a non-required limb.

Having regard to the acoustic decoupling element provided between the tub and the tub rim, it should at this point be expressly stated that this can also be sensibly used, without the other features of the invention, in the support systems known from the prior art. Simply through the use of the acoustic decoupling elements a substantial improvement of the achievable acoustic insulating characteristics can be brought about. In the context of the invention, protection is also claimed for the use of the said acoustic decoupling element only in combination with support systems known from the prior art.

Figure 10C:
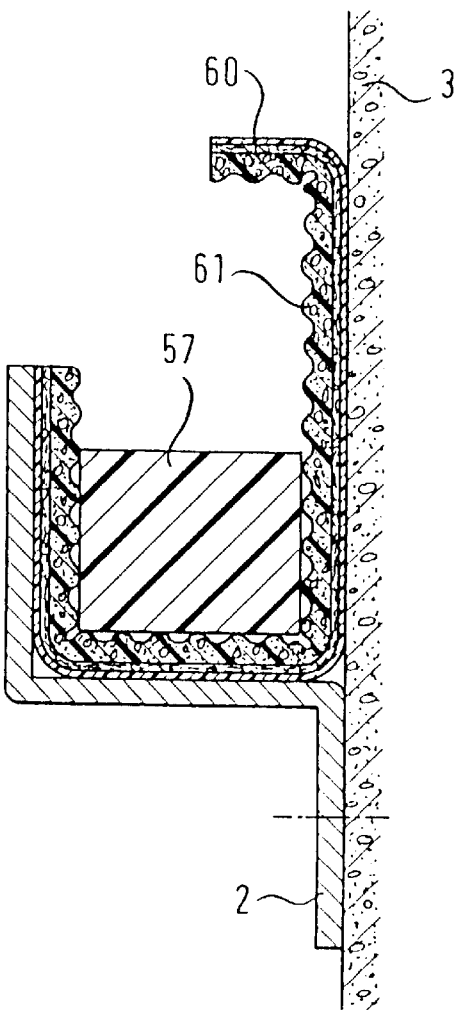
FIGS. 10*a* to 10*c* show further embodiments of an acoustic decoupling layer which can be used in conjunction with a support rail.
Figure 10B:
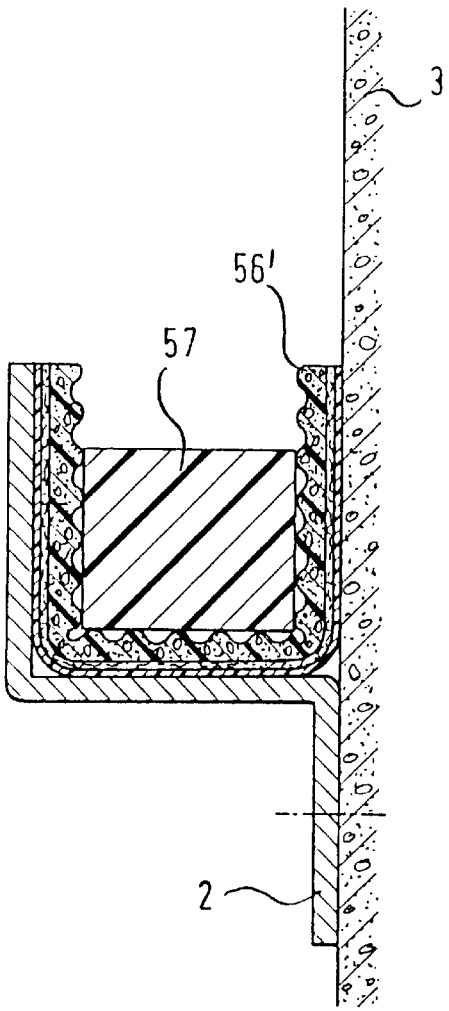
Figure 10A:
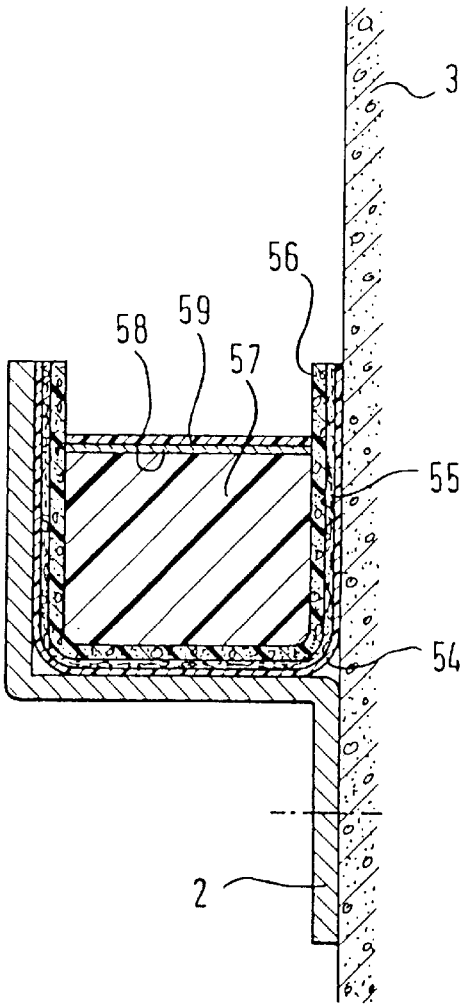

FIGS. 10*a* to 10*c* show further possible embodiments of an acoustic decoupling layer with which a support rail 2 can be lined.

The acoustic decoupling layers in accordance with FIGS. 10*a* to 10*c* all have the following layer construction:

The outermost layer which stands directly in contact with the support rail or with the wall 3 is formed by a foil 54 which is in particular reinforced by a grid structure. At the inner side it is contacted by a fiber layer 55 and at the inner side of the fiber layer there is in turn arranged a foam material layer 56.

The layer composite 54, 55, 56 has a substantially U-shaped cross-section, the free inner cross-section of which is filled out in its lower region with an acoustically insulating cushion layer 57.

The embodiment of FIG. 10*b* corresponds substantially to the described embodiment of FIG. 10*a* with the difference that the inwardly disposed foam material layer 56'"of FIG. 10*b* is provided with a grooved profile.

The upper side of the cushion layer 57 on which ultimately the tub of the tub which is not shown in FIG. 10 is placed can be covered, in accordance with FIG. 10*a*, with a load distribution layer 58 which, for example, consists of hard plastic or aluminum and which ensures that the force exerted by the tub on the cushion layer 47 is uniformly distributed.

A further layer or layer composite 59 can preferably be arranged above the load distribution layer 58 and consists of a foam layer, a fiber layer and/or a foil layer, with it being possible for the foil layer to be formed with a grid reinforcement.

The layers 58, 59 can likewise be provided in the embodiments of FIGS. 10*b* and 10*c*.

In the embodiment of FIG. 10*c* the wall-side vertical limb of the acoustic decoupling layer extends further upwardly than in the embodiment of FIGS. 10*a* and 10*b*. This extended limb is bent away from the wall 3 at right angles in its upper region, whereby a support surface or distance marker 60 results for tiles which are subsequently to be mounted on the wall 3 above the support surface or the distance marker 60.

At the same time the extended vertical region 61 forms an acoustic decoupling layer between the rim of the tub supported on the cushion layer 57 and the wall 3.

In this manner, the layer composite or layer assembly shown in FIG. 10*c* and correspondingly molded simultaneously satisfies the tasks of the inventive acoustic decoupling layer coupled to the support rail and of the acoustic decoupling element at the wall side. Through this one-piece embodiment of the acoustic decoupling layer of the acoustic decoupling element, the installation is additionally simplified because the number of parts that are required is correspondingly reduced. Moreover, cost saving results during manufacture.

The materials of the composite layer in accordance with FIG. 10, optionally including the cushion layer 57, can be achieved in a particularly advantageous and simple manner if one correspondingly cuts up a compact insulating sleeve for the insulation of pipe conduits which have in the meantime become known from the prior art. Thus, for the manufacture of the insulating materials that are required, it is possible to turn to commercially available products without a new manufacturing process being required.

FIG. 11 shows the support of a tub rim 62 of a commercially available plastic tub on a support wall 63 erected beneath the tub rim 62 in front of the tub, with the support wall being provided with thin-bed tiling 64.

The upper end of the support wall 63 is occupied by an acoustic decoupling sectional element 65 of U-shaped cross-section, the vertical limb of which at the outer side of the tub adjoins the tiling 64 at its end face.

The vertically extending outer side region of the tub rim 62 finishes just above the tiling 64, so that a gap is formed between the end face of the tub rim 62 and the tiling 64.

This gap can be provided with a permanent elastic jointing 66 which, in particular, consists of silicone.

The total thickness of the sectional element 65 and tub rim 62 corresponds to the thickness of the thin-bed tiling 64, so that a flush transition results at the outer side of the tub between the tub rim 62 and the tiling 64.

Figure 11A:
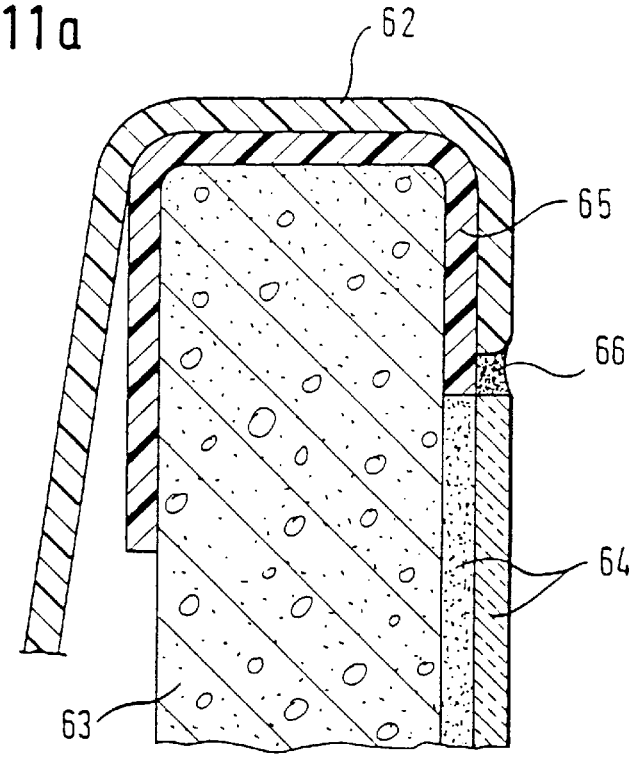
FIGS. 11*a*, 11*b* show possibilities in accordance with the invention for supporting a tub rim on a support wall.
Figure 11B:
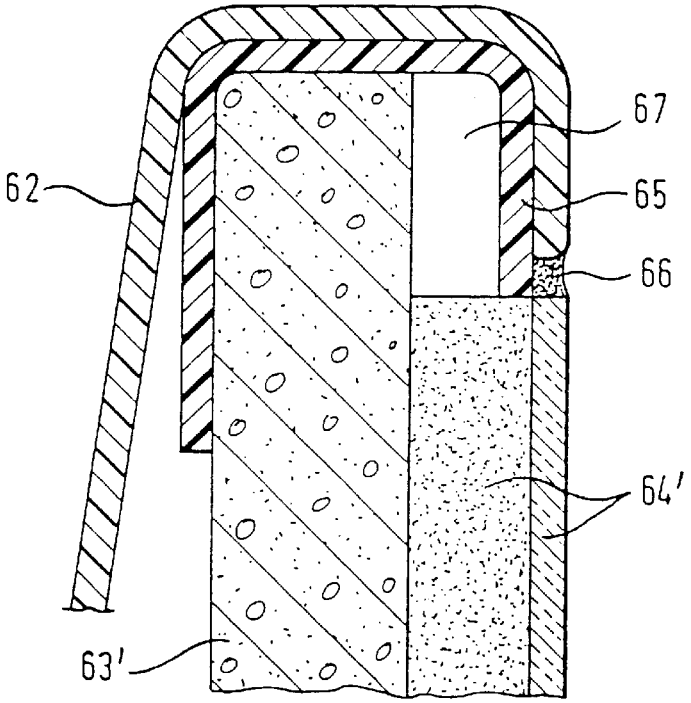

FIG. 11*b* shows an embodiment in which, in distinction to FIG. 11*a*, a thinner support wall 63' is used with thick-bed tiling 64'.

The sectional element 65 of FIG. 11*b* has the same dimensions as the sectional element 65 of FIG. 11*a*. Since a thinner support wall 63' is used in FIG. 11*b*, a hollow cavity 67 forms between the vertical limb of the sectional element 65 at the tub outer side and the opposite region of the support wall 63' but is not, however, disturbing.

Figure 12A:
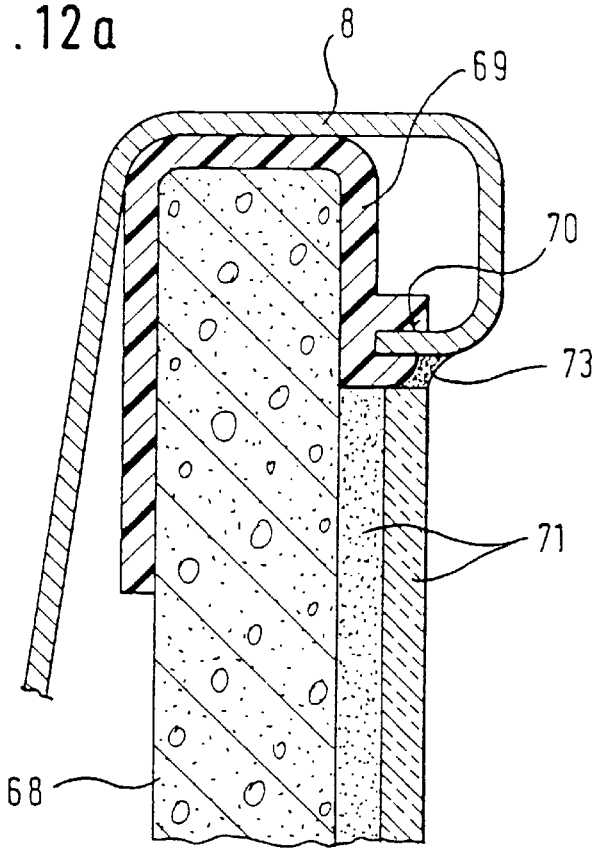
FIGS. 12*a*, 12*b* show further possibilities in accordance with the invention of supporting a tub rim on a support wall, and FIG. 13*a* show a possible embodiment of a support member in accordance with accordance with the invention, FIG. 13*b* show a further possible embodiment of a support member in accordance with the invention.
Figure 12B:
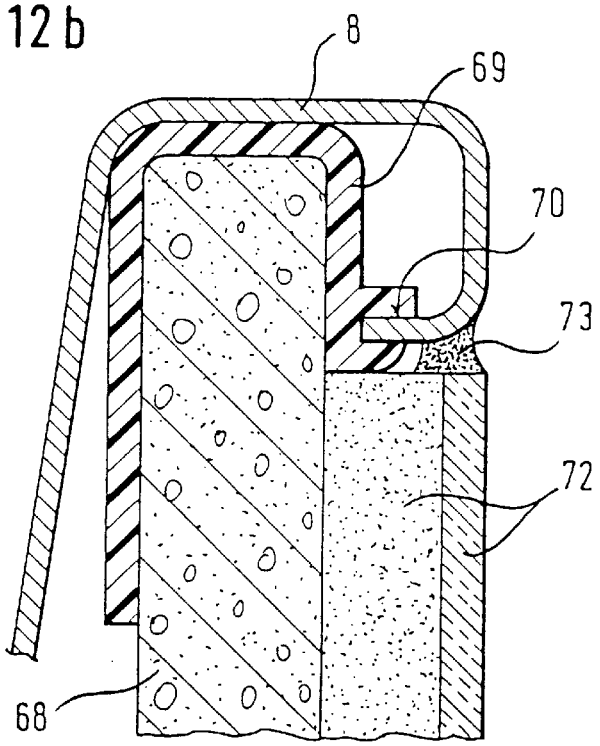

FIGS. 12*a* and 12*b* in each case show the support of an outwardly and downwardly bent tub rim 8 of a customary steel bath tub on a support wall 68.

The upper region of the support wall 68 is occupied, both in the embodiment of FIG. 8*a* and also in the embodiment of FIG. 8*b* by an acoustically decoupling sectional element 69 which reliably prevents a direct contact between the tub rim and the support wall 68. A groove 70 is molded onto the vertical limb of the sectional element 69 remote from the tub and serves to receive the end edge of the tub rim 8.

Thin-bed tiling 71 is provided beneath the groove region of the sectional element 69 in accordance with FIG. 8*a* and thick-bed tiling 72 is provided at the support wall 68 in accordance with FIG. 12*b*.

The gap which exists between the rim 8 of the tub and the tiling 71 or 72 respectively is in each case sealed off with a joint filler 73 of a permanent elastic material, in particular of silicone.

Figure 13A:
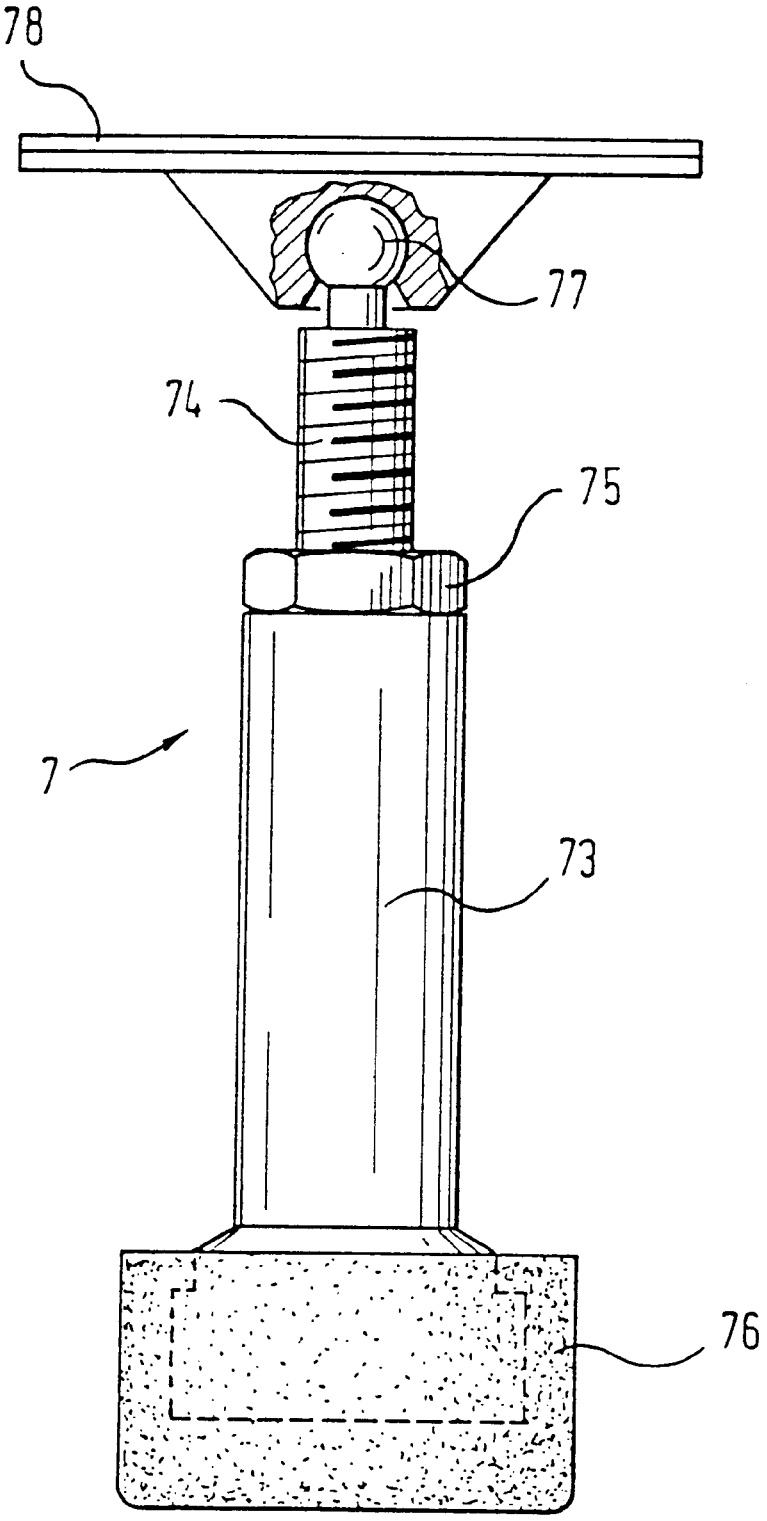

FIG. 13*a* shows a support member 7 in accordance with the invention which can be arranged between the tub base and the floor screed or the rough floor.

The support member 7 consists of a support foot 73 which is provided with an inner thread into which a threaded rod 74 is screwed. A counter-nut 75 is provided in order to prevent undesired adjustment of the threaded bar 74 in the support foot 73.

The height of the support member 7 can be adjusted and matched to the prevailing requirements by means of the elements 73, 74, 75. The height of the of the total support member can, in particular, be adjusted in a range of 110–190 mm.

The lower end of the support foot 73 is covered over by means of an acoustically decoupling cap 76.

After the mounting of the support member at a tub, it is only the cap 76 which has connection to the floor screed or to the rough floor, whereby an effective acoustic decoupling is achieved between the tub and the floor screed or rough floor.

A ball joint 77 is arranged at the upper end of the threaded bar 78 via which the threaded bar 74 is connected to a support disc 78 which is, in particular, self-adhesive.

Through the ball joint 77, the support disc 78 can be respectively adapted to the inclination of the base of the tub in such a way that a full area contact of the support disc 78 at the base of the tub results. The support disc 78 can be made so that it is acoustically decoupling at the top and/or at the bottom or, for example, can also be connected to additional acoustic decoupling discs, so that no bridges for structure-borne noise exists between the tub and the support member.

Figure 13B:
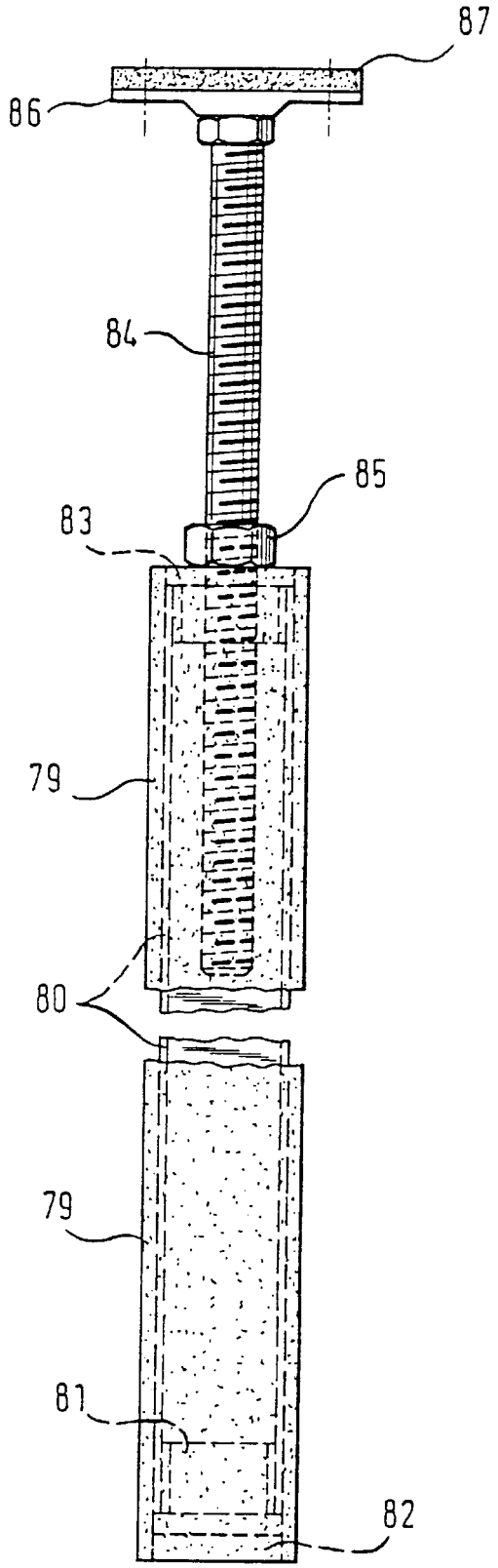

In an alternative and more stable embodiment of the support member, no ball joint is provided, but rather the upper end of the support member contacts the tub base directly or simply via a support disc which is, for example, acoustically decoupling (FIG. 13*b*).

The upper end of the threaded bar 74 can, with an embodiment which is not shown in FIG. 13*a*, be screwed into a tube with an inner thread which is then directly or indirectly contacted with the tub base via a support disc. A further locking nut can be provided in order to also prevent undesired adjustment of the threaded bar 74 in the tube here.

Figure 14:
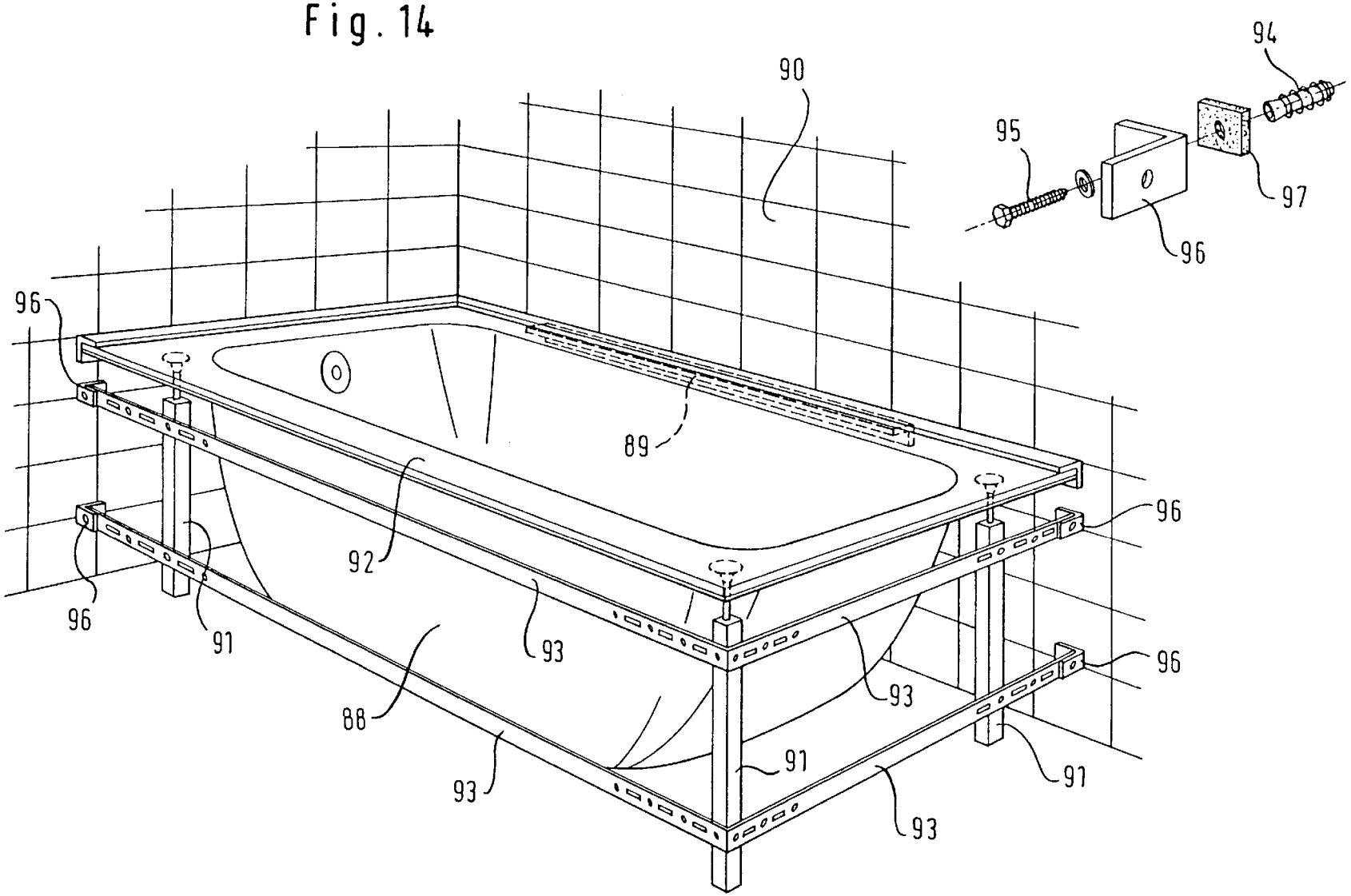
FIG. 14 is a support system in accordance with the invention for use with dry construction.

The threaded bar 74 can also be connected at its upper end with a corner-shaped sectional element, for example an angle element or support element, with it being possible to secure dry construction boards for dry paneling to this support element (FIG. 14).

The threaded bar 74, the above mentioned tube with the inner thread and/or the support foot 73 can be jacketed with an insulation element, which can for example consist of air-noise insulating foam-fleece composite, which can be protected against damage at the outer side by a grid-foil layer. In this manner, the support members are additionally acoustically decoupled from the walling.

FIG. 13*b* shows a support element of this kind which is jacketed with an insulating element or with an insulating hose 79.

The support member of FIG. 13*b* has a support foot 80 which car, for example, be formed as a four-cornered tube. The support foot 80 is jacketed with the insulating hose 79 over its entire height.

At its lower end, the support foot 80 is terminated by a four-cornered plug 81 which is adjoined at its lower side by an acoustic protection disc 82 which is preferably adhesive at one side and which acoustically decouples the support member relative to the floor screed.

At its upper end, the support foot 80 is provided with a four-cornered threaded plug 83 into which a threaded bar 84 can be screwed. The threaded bar 84 is held in the support foot 80 in am adjustable position by means of a locking nut 85.

The support member illustrated in FIG. 13*b* can be set to various heights by screwing the threaded bar 84 into the support foot 80 to different depths.

A screw foot 86 is firmly connected to the upper end of the threaded bar 84 and its top side is occupied by a further acoustic protection disc 87. This acoustic protection disc 87 can serve to technically and acoustically decouple the tub rim relative to the illustrated support member.

Instead of a support element in accordance with FIGS. 13*a, b,* support Wedges or support blocks which are likewise manufactured of acoustically decoupling solid material can be used.

FIG. 14 shows a support system in accordance with the invention when used with dry construction.

The tub 88 shown is supported at the wall 90 at one side via a support rail 89.

Furthermore, at least three support members 91 are provided which can, for example, be formed in accordance with FIG. 13*b*. The support members 91 are respectively arranged in the corner regions of the tub rim 92 and support the latter relative to the floor screed.

An acoustic decoupling as explained above exists between the support rail 89 and the wall 90 and between the support rail 89 and the tub rim 92. Furthermore, the tub rim 92 can also be arranged in an acoustically decoupled manner relative to the wall 90 in those regions in which no support rail 89 is present.

The support members 91 each carry two dry paneling rails 93 which are arranged horizontally above one another and which are firmly connected to the wall 90 at their wall-side ends.

The connection location between the dry paneling rails 93 and the wall 90 is shown in detail in FIG. 14 at the top right. Here, an acoustically insulating dowel 94 is shown which is inserted into the wall 90 and into which a screw 95 can be screwed which holds a holding angle 96 at the wall through the intermediary of a decoupling strip 97.

Decoupling strip 97 and acoustic insulating dowel 94 ensure an acoustic decoupling of the dry paneling rail 93 relative to the wall.

Dry paneling can be mounted in the customary manner to the dry paneling rails 93.

What is claimed is:

1. A support system adapted to be used for bath or shower tubs that includes a tub rim, the support system comprising at least one support rail adapted to be secured to a primary wall at a wall side of the support rail; support members that comprise at least one acoustically decoupling insulating element; an acoustic decoupling layer that is adapted to occupy surfaces of at least one of the primary wall and the support rail; and an acoustically decoupling sectional element that is adapted to be positioned between the tub rim and an adjacent support wall.

2. A support system in accordance with claim 1, wherein a wall side acoustically decoupling element is additionally provided, which can be positioned between the wall and a region of the tub rim facing it.

3. A support system in accordance with claim 2, wherein the dimensions of the wall side acoustically decoupling element are adapted to tiling to be applied to the wall side.

4. A support system in accordance with claim 2, wherein the wall side acoustically decoupling element consists of a plurality of part elements which are connected together or connectable together.

5. A support system in accordance with claim 4, wherein the plurality of part elements are telescopically displaceable relative to one another.

6. A support system in accordance with claim 2, wherein the wall side acoustic decoupling element is provided with at least one longitudinally extending groove which marks a position of intended breakage or a cutting line.

7. A support system in accordance with claim 2, wherein the wall side acoustic decoupling element is suitable for the sealing of the region located between the tub rim and the wall against a gush of water and water spray.

8. A support system in accordance with claim 2, wherein the wall side acoustic decoupling element is attachable to the wall by means of a holding section.

9. A support system in accordance with claim 2, wherein the wall side acoustically decoupling element has a L-shaped cross-section.

10. A support system in accordance with claim 1, wherein up to three straight support rails are provided in order to support a rectangular or square tub at up to three walls.

11. A support system in accordance with claim 1, wherein up to three straight sectional elements are provided in order to support a rectangular or square tub at up to three support walls.

12. A support system in accordance with claim 1, wherein the support rail has a substantially Z-shaped cross-section.

13. A support system in accordance with claim 12, wherein the support rail is formed of metal.

14. A support system in accordance with claim 1, wherein the acoustically decoupling layer of the support rail is covered at the side remote from the support rail with a load distribution layer.

15. A support system in accordance with claim 14, wherein the load distribution layer consists of one of either hard plastic or aluminum.

16. A support system in accordance with claim 1, wherein the acoustically decoupling layer of the support rail has a substantially U-shaped cross-section.

17. A support system in accordance with claim 1, wherein the acoustic decoupling layer consists of an inwardly disposed foam layer, an outwardly adjoining fiber layer and a foil layer which outwardly adjoins the fiber layer.

18. A support system in accordance with claim 17, wherein said foil layer is reinforced by a grid structure.

19. A support system in accordance with claim 17, wherein said inwardly disposed foam material layer is provided at its inner side with a groove profile.

20. A support system in accordance with claim 19, wherein said cushion layer is covered at its side facing the tub rim with a load distribution layer.

21. A support system in accordance with claim 20, wherein said load distribution layer comprises at least one of the group comprising hard plastic and aluminum.

22. A support system in accordance with claim 20, wherein said load distribution layer is covered at its side facing the tub rim with at least one of a foam material, fiber and grid reinforced foil layer.

23. A support system in accordance with claim 17, wherein the lower region of the free inner cross-section of the foam material layer is filled with a noise-insulating cushion layer.

24. A support system in accordance with claim 1, wherein an acoustic decoupling element having a layer construction comprising an inwardly disposed foam layer, an outwardly adjoining fiber layer and a foil layer outwardly adjoining the fiber layer, is positional between the wall and the region of the tub rim facing it.

25. A support system in accordance with claim 1, wherein the acoustic decoupling element and the acoustic decoupling layer are formed in one piece.

26. A support system in accordance with claim 1, wherein at least two support members are provided, with the support members being capable of being supported at their upper ends at at least one of the tub base and the tub rim.

27. A support system in accordance with claim 1, wherein the support members are vertically adjustable.

28. A support system in accordance with claim 27, wherein said support members are covered by means of a acoustically decoupling cap.

29. A support system in accordance with claim 28, wherein the support members are covered by their respective acoustically decoupling cap at an end remote from the tub.

30. A support system in accordance with claim 27, wherein the end of the support members facing the tub has a support surface.

31. A support system in accordance with claim 30, wherein the support surface is an acoustically decoupling support surface.

32. A support system in accordance with claim 30, wherein said support surface is pivotable and adapted to be matched to the inclination of the tub base.

33. A support system in accordance with claim 30, wherein said support members are formed by one of support blocks consisting of acoustically decoupling material.

34. A support system in accordance with claim 1, wherein the sectional element positionable between the tub rim and the support wall has a substantially U-shaped cross-section.

35. A support system in accordance with claim 34, wherein said substantially U-shaped cross-section has limbs of different lengths.

36. A support system in accordance with claim 35, wherein said sectional element positional between the tub rim and the support wall has a groove to receive an outwardly bent over tub rim.

37. A support system in accordance with claim 1, wherein the acoustically decoupling material consists of at least one of the group comprising soft resilient material, soft plastic, polystyrene, cork, elastomeric materials, rubber, natural rubber, coconut, soft foam, hard foam, and polyurethane elastomer.

38. A support system in accordance with claim 37, wherein the acoustically decoupling material consists of PE foam.

39. A support system in accordance with claim 1, wherein the acoustically decoupling materials have openings which improve the insulating action, said openings extending in the direction of the longitudinal axis of the acoustically decoupling materials or transversely thereto.

40. A support system in accordance with claim 39, wherein the openings consist of one of either bores, elongate holes, or slits.

41. A support system in accordance with claim 1, wherein the support rail, the sectional element positionable between the tub rim and the support wall, and the wall side acoustically decoupling element are formed as individual pieces which can be placed alongside one another in the longitudinal direction.

42. A support system in accordance with claim 41, where all parts are moisture-resistant.

43. A support system in accordance with claim 11, wherein said individual pieces have a length of 60, 90 or 120 cm.

* * * * *